US010179966B2

(12) United States Patent
Kim et al.

(10) Patent No.: US 10,179,966 B2
(45) Date of Patent: Jan. 15, 2019

(54) LAUNDRY TREATMENT APPARATUS

(71) Applicant: LG ELECTRONICS INC., Seoul (KR)

(72) Inventors: Doohyun Kim, Seoul (KR); Hoosun Lee, Seoul (KR); Seungwoo Han, Seoul (KR); Jeongkon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 252 days.

(21) Appl. No.: 15/085,098

(22) Filed: Mar. 30, 2016

(65) Prior Publication Data

US 2016/0289885 A1 Oct. 6, 2016

(30) Foreign Application Priority Data

Mar. 30, 2015 (KR) ..... 10-2015-0044208
Mar. 30, 2015 (KR) ..... 10-2015-0044209

(51) Int. Cl.
*F26B 5/04* (2006.01)
*D06F 58/20* (2006.01)
(Continued)

(52) U.S. Cl.
CPC ..... *D06F 58/206* (2013.01); *D06F 25/00* (2013.01); *D06F 58/02* (2013.01); *D06F 58/24* (2013.01)

(58) Field of Classification Search
CPC ..... D06F 58/206; D06F 58/24; D06F 25/00; F28F 17/005
(Continued)

(56) References Cited

U.S. PATENT DOCUMENTS 7,526,879 B2 * 5/2009 Bae ..... D06F 58/206 34/239
8,578,626 B2 * 11/2013 Steffens ..... D06F 58/24 134/198
(Continued)

FOREIGN PATENT DOCUMENTS

CN 102471987 5/2012
DE 202009005871 9/2010
(Continued)

OTHER PUBLICATIONS

China Office Action in Chinese Application No. 201610191426.9, dated Sep. 20, 2017, 13 pages (with English translation).
(Continued)

*Primary Examiner* — John McCormack
(74) *Attorney, Agent, or Firm* — Fish & Richardson P.C.

(57) ABSTRACT

A laundry treatment apparatus equipped with a thermoelectric module includes a thermoelectric element configured to emit heat from a first surface and to absorb heat through a second surface, a first heat exchange unit configured to contact the first surface of the thermoelectric element to undergo heat exchange with air upon receiving heat from the first surface, a heat transfer member having an interconnecting surface that is configured to contact the second surface of the thermoelectric element to be in a heat conducting relationship with the second surface, and a second heat exchange unit configured to contact the interconnecting surface of the heat transfer member, and that is configured to undergo heat exchange with air to enable heat to be absorbed by the second surface of the thermoelectric element through the heat transfer member.

17 Claims, 14 Drawing Sheets

(51) Int. Cl.
*D06F 58/24* (2006.01)
*D06F 25/00* (2006.01)
*D06F 58/02* (2006.01)

(58) Field of Classification Search
USPC ..... 34/407, 408, 448, 449, 468, 73–78; 165/231, DIG. 212, 210, 198 S; 62/3.4, 62/272, 279
See application file for complete search history.

(56) References Cited

U.S. PATENT DOCUMENTS

| | | | | |
|---|---|---|---|---|
| 8,640,466 | B2 * | 2/2014 | Bell | F25B 21/02 165/166 |
| 2007/0101602 | A1 | 5/2007 | Bae et al. | |
| 2015/0000886 | A1 * | 1/2015 | Lee | B23P 15/26 165/185 |
| 2015/0259847 | A1 * | 9/2015 | Kohavi | F16L 53/00 34/468 |

FOREIGN PATENT DOCUMENTS

| | | |
|---|---|---|
| EP | 2915915 | 9/2015 |
| JP | 2011-106723 | 6/2011 |
| KR | 10-2006-0107037 | 10/2006 |
| KR | 10-2010-0082471 | 7/2010 |
| KR | 10-1305523 | 9/2013 |
| KR | 10-1313591 | 10/2013 |
| WO | 2011/154336 | 12/2011 |

OTHER PUBLICATIONS

Extended European Search Report issued in European Application No. 16162548.8 dated Jun. 13, 2016, 11 pages.
International Search Report in International Application No. PCT/KR2016/003273, dated Aug. 8, 2016, 3 pages.

* cited by examiner

LAUNDRY TREATMENT APPARATUS

CROSS-REFERENCE TO RELATED APPLICATIONS

This application claims the priority benefit of Korean Patent Application Nos. 10-2015-0044208, filed on Mar. 30, 2015, and 10-2015-0044209, filed on Mar. 30, 2015, in the Korean Intellectual Property Office, the disclosures of which are incorporated herein by reference.

FIELD

The present disclosure relates to a laundry treatment apparatus equipped with a thermoelectric module.

BACKGROUND

Generally, a laundry treatment appliance refers to an apparatus that can treat laundry by applying physical and/or chemical operations to laundry. For example, a washing machine, which can remove contaminants adhered to laundry, a dehydration machine, which can dehydrate laundry by rotating a wash tub in which laundry is accommodated at a high speed, and a drying machine, which can dry wet laundry by supplying cold air or hot air into a wash tub, may be collectively referred to as laundry treatment appliances.

Laundry treatment apparatuses that are capable of drying clothes may be classified into an exhaust type drying system and a circulation (condensation) type drying system based on the flow of high-temperature air (hot air) supplied to clothes.

The circulation type drying system generally has a configuration in which, after the removal of moisture from air discharged from a tub (dehumidification), the air is reheated and resupplied into the tub.

The exhaust type drying system generally has a configuration in which heated air is supplied into a tub and air discharged from the tub is discharged out of a laundry treatment apparatus, rather than being resupplied into the tub.

SUMMARY

According to one aspect, a laundry treatment apparatus equipped with a thermoelectric module includes a thermoelectric element having a first surface and a second surface that is opposite the first surface, the thermoelectric element being configured to emit heat from the first surface and to absorb heat through the second surface, a first heat exchange unit configured to contact the first surface of the thermoelectric element so as to undergo heat exchange with air upon receiving heat from the first surface, a heat transfer member having an interconnecting surface that is configured to contact the second surface of the thermoelectric element so as to be in a heat conducting relationship with the second surface, and a second heat exchange unit configured to contact the interconnecting surface of the heat transfer member, the second heat exchange unit being configured to undergo heat exchange with air upon receiving heat from the second surface of the thermoelectric element through the heat transfer member.

Implementations according to this aspect may include one or more of the following features. For example, the first heat exchange unit and the second heat exchange unit may define a space therebetween, the space being configured to prevent movement of condensed water from the second heat exchange unit to the first heat exchange unit. The first heat exchange unit and the second heat exchange unit may be arranged in a line. The first heat exchange unit may be configured to emit heat upon undergoing heat exchange with air, and the second heat exchange unit may be configured to absorb heat upon undergoing heat exchange with air. At least one of the first heat exchange unit or the second heat exchange unit may include a sloped surface that is configured to guide condensed water. An end portion of the heat transfer member may include a jagged structure that is configured to collect and drop condensed water. The jagged structure may be extended along a longitudinal direction of the heat transfer member. The jagged structure may include a plurality of protruding drop portions extending in a longitudinal direction of the heat transfer member and a groove defined between the respective neighboring protruding drop portions. The thermoelectric element may be configured to emit heat based on the Peltier effect.

In some implementations, at least one of the first heat exchange unit or the second heat exchange unit may include a plurality of radiation fins, wherein ends of the radiation fins may be arranged in a zigzag form. The first heat exchange unit and the second heat exchange unit may be vertically arranged in the direction of gravity. The first heat exchange unit and the second heat exchange unit may be horizontally arranged.

In some cases, the laundry treatment apparatus may further include a cabinet defining an external appearance of the laundry treatment apparatus, a tub configured to receive wash water therein, a drum placed inside the tub, the drum being configured to receive fabric therein and to rotate, and a condenser unit connected to the tub, the condenser unit being configured to remove moisture by circulating air inside the tub. The condenser unit may include a condenser duct connected to the tub and configured to enable circulation of the air inside the tub, and a condenser fan installed in the condenser duct and configured to circulate the air inside the tub. The thermoelectric module may be installed in the condenser duct and configured to cool and heat the air moving along the condenser duct. The laundry treatment apparatus may further include a heater installed in the condenser duct and configured to heat the air having passed through the thermoelectric module. The second heat exchange unit may be configured to condense moisture in the air by cooling the air, and the first heat exchange unit may be configured to heat the air from which the moisture has been condensed. The heater may be configured to heat the air having passed through the first heat exchange unit. The thermoelectric module may be located between the condenser fan and the heater. Additionally, the second heat exchange unit, the first heat exchange unit, and the heater may be sequentially arranged in a line. The thermoelectric module may include two thermoelectric modules arranged to face each other, and the two first heat exchange units and the two second heat exchange units may be arranged between the two heat transfer members.

In some implementations, the laundry treatment apparatus may further include a cabinet defining an external appearance of the laundry treatment apparatus, a drum placed inside the cabinet, the drum being configured to receive fabric therein and to rotate, and a condenser unit installed in the cabinet, the condenser unit being configured to remove moisture by circulating air inside the drum. The condenser unit may include a condensation heat exchanger defining a first heat exchange flow path for movement of outside air and a second heat exchange flow path for movement of the air inside the drum, the condensation heat exchanger being configured to perform heat exchange between the outside air and the air inside the drum so as to dehumidify the air inside the drum, and the thermoelectric module may be configured to dehumidify and heat the air having passed through the second heat exchange flow path. In some cases, the laundry treatment apparatus may further include a heater configured to heat the air having passed through the thermoelectric module before the air moves to the drum. The second heat exchange unit may be configured to condense moisture in the air by cooling the air, and the first heat exchanger may be configured to heat the air from which the moisture has been condensed. The heater may be configured to heat the air having passed through the first heat exchange unit. The thermoelectric module may be located between the condensation heat exchanger and the heater

DETAILED DESCRIPTION

Figure 1:
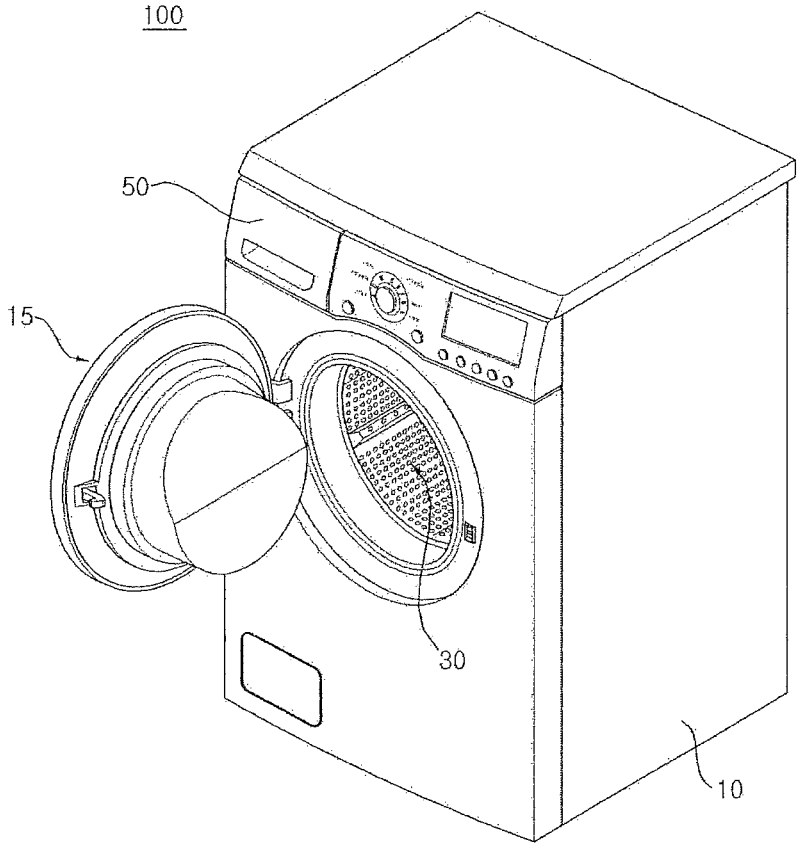
FIG. 1 is a perspective view of an example washing machine according to one implementation.

Referring to FIGS. 1 to 5, a washing machine 100 in accordance with one implementation includes a cabinet 10, which defines the external appearance of the washing machine 100, a tub 20 in which wash water can be accommodated, a drum 30, which is placed inside the tub 20 and can be rotated while accommodating fabric therein, a drive unit 40, which can be used to rotate the drum 30, a water supply unit, which can receive wash water from an external water source and supply the wash water into the tub 20, a detergent box 50 in which detergent may be accommodated, the detergent box 50 being configured to mix wash water and detergent with each other, a pump 60, which can circulate wash water such that the wash water is discharged from the tub 20 and is then resupplied into the tub 20, a heater module 70, which is placed inside the tub 20 and serves to heat wash water, and a condenser unit 80, which is connected to the tub 20 and can serve to remove moisture from the air inside the tub 20 while circulating the air.

The cabinet 10 defines the external appearance of the washing machine 100. The tub 20 is provided inside the cabinet 10. The cabinet 10 may define a fabric introduction/discharge hole 21 that enables the introduction or discharge of fabric. A door 15 may be rotatably provided on the front surface of the cabinet 10 to enable the opening or closing of the fabric introduction/discharge hole 21.

A suspension structure, such as a spring unit and a damper, may be installed between the tub 20 and the cabinet 10. The suspension structure may help lessen the transmission of vibrations from the tub 20 to the cabinet 10.

The tub 20 is configured to accommodate wash water therein. In turn, the drum 30 is placed inside the tub 20. The tub 20 may include a water level sensor, which can sense the level of wash water accommodated in the tub 20.

Laundry (hereinafter referred to as "fabric") may be introduced into the drum 30 through the fabric introduction/discharge hole 21. The fabric can thus be accommodated inside the drum 30.

The drum 30 may define a plurality of drum through-holes 33 that allow for the passage of wash water. A lifter 32 may be located on the inner wall of the drum 30. When the drum 30 is rotated, the lifter 32 can lift the fabric to a given height. The fabric, lifted by the lifter 32, subsequently falls back down due to its weight. The drum 30 can be rotated by receiving torque from the drive unit 40.

In some cases, the drum 30 may not be perfectly horizontally oriented, but may instead be tilted such that the rear side of the drum 30 is positioned vertically lower than the inlet of the drum 30.

The detergent box 50 may be configured to accommodate detergent such as, for example, laundry detergent, a fabric softener, and a bleaching agent. The detergent box 50 may be provided on the front surface of the cabinet 10 so as to be pulled out and pushed into the cabinet 10. The detergent inside the detergent box 50 is mixed with wash water during the supply of wash water to thereby be introduced into the tub 20. The detergent box 50 may be divided into a section in which laundry detergent is accommodated, a section in which a fabric softener is accommodated, and a section in which a bleaching agent is accommodated.

The heater module 70 may be located in the lower region of the tub 20.

When power is applied to the heater module 70 in a washing mode, the heater module 70 may heat wash water stored inside the tub 20. In addition, when power is applied to the heater module 70 in a drying mode, the heater module 70 may heat the air inside the tub 20.

The condenser unit 80, which is used in a washing machine having a circulation type drying system, is configured to condense and remove moisture from the air inside the tub 20. The condensed water may be discharged outward via the pump 60.

In the drying mode, the condenser unit 80 can help reduce the humidity of air inside the tub 20, thereby improving drying efficiency.

The condenser unit 80 does not typically discharge hot air outward from the cabinet 10. When drying is performed using the heater module 70, the cabinet 10 may become warm, or may discharge heated air to the surroundings.

When the drying mode is performed through the use of the condenser unit 80, variation in temperature around the cabinet 10 may be minimized.

As illustrated, the condenser unit 80 may include a condenser duct 82, which is connected to the tub 20, a condenser fan 84, which is installed in the condenser duct 82 and circulates air inside the tub 20, a thermoelectric module 110, which is installed in the condenser duct 82 and cools and heats moving air, and a heater 86, which is installed in the condenser duct 82 and heats the air having passed through the thermoelectric module 110.

As illustrated, the condenser unit 80 may be installed on the top of the tub 20. The condenser unit 80 may be installed outside the tub 20 while still being connected to the interior of the tub 20.

In some cases, the condenser unit 80 may be installed on the side surface, the rear surface, or the lower surface of the tub 20.

The condenser duct 82 may be connected, at one end thereof, to the front side of the tub 20, and may be connected, at the other end thereof, to the rear side of the tub 20.

The heater 86 is a device that can generate heat upon receiving power, and may be, for example, a positive temperature coefficient (PTC) heater.

The condenser fan 84 may be any of various kinds of fans such as, for example, an axial flow fan or a turbo fan. The condenser fan 84 can move air inside the tub 20 to the condenser duct 82. The air inside the tub 20 can be circulated by the condenser fan 84.

The thermoelectric module 110 is a device having an integrated thermoelectric element, which can perform heat absorption on one surface thereof and heat emission from an opposite surface thereof based on the Peltier effect. Generally, the thermoelectric element is manufactured by combining a P-type semiconductor with an N-type semiconductor. Accordingly, the thermoelectric module 110 cool and heat moving air.

As illustrated, the thermoelectric module 110 may include a feature such that an air cooling part and an air heating part are aligned with each other in a line within the condenser duct 82. Accordingly, air moving in the condenser duct 82 linearly passes through the thermoelectric module 110. Only one flow path is defined in the condenser duct 82, and the thermoelectric module 110 is located in the flow path.

The thermoelectric module 110 may have minimal resistance to moving air. Subsequently, when the resistance of air passing through the thermoelectric module 110 is reduced, the load on the condenser fan 84 may be reduced, and operational noise may also be reduced.

Figure 2:
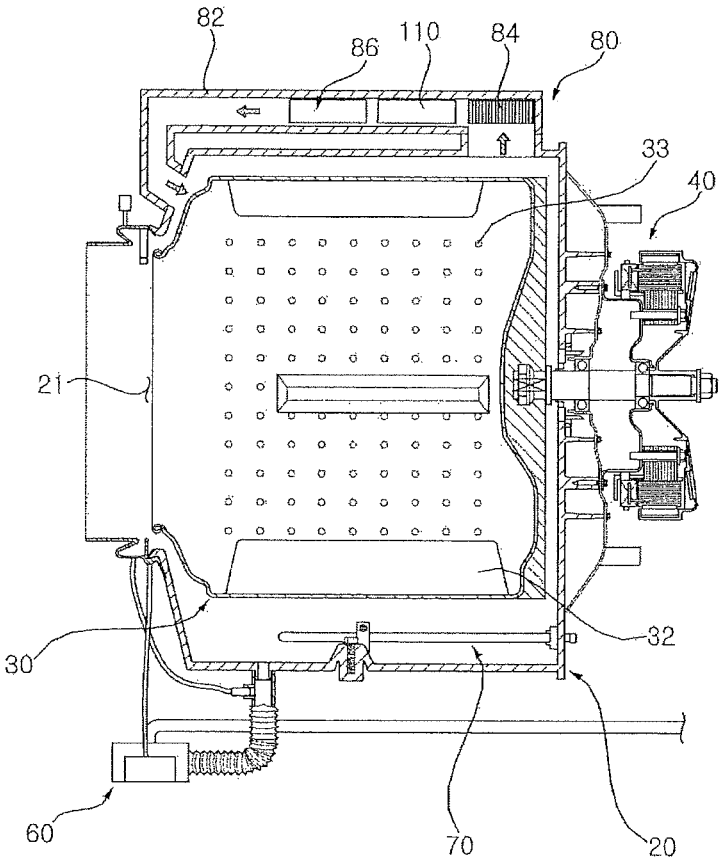
FIG. 2 is a sectional view illustrating the interior configuration of FIG. 1.
Figure 3:
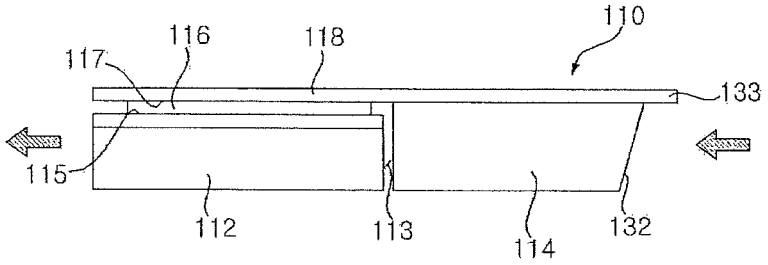
FIG. 3 is a sectional view of an example thermoelectric module illustrated in FIG. 2.
Figure 4:
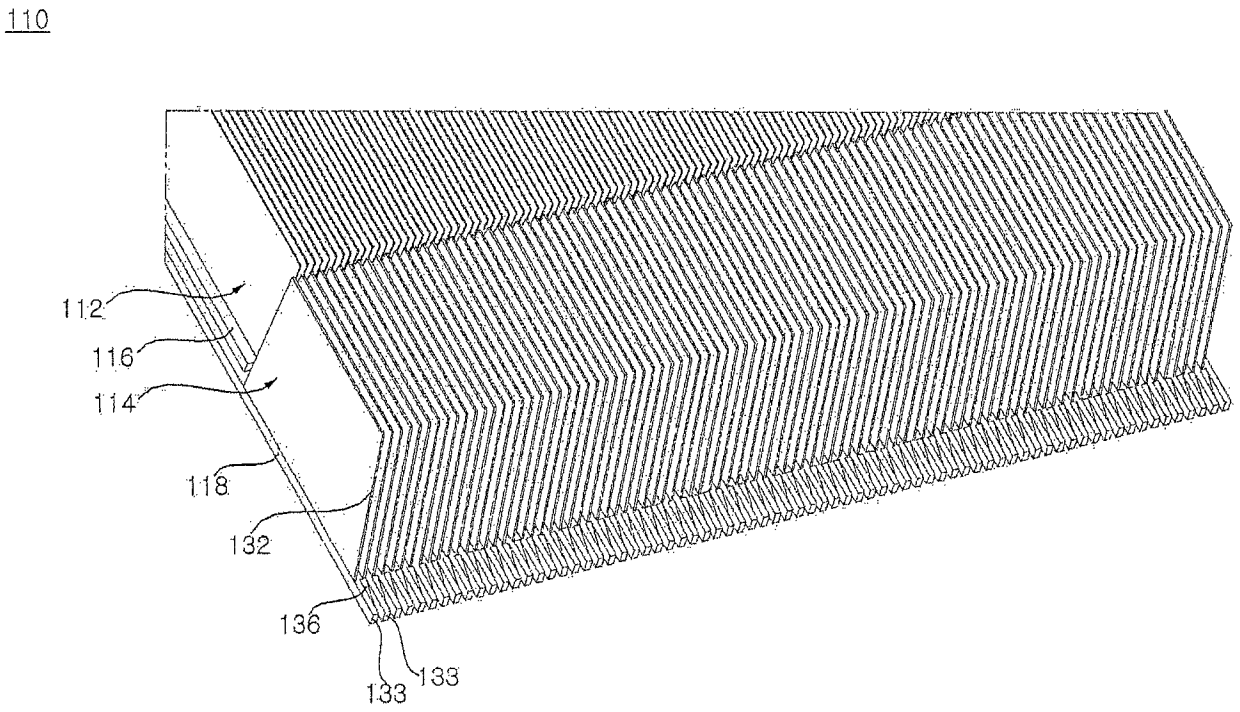
FIG. 4 is a partial perspective view of the thermoelectric module illustrated in FIG. 3.

As illustrated in FIGS. 2 and 3, the thermoelectric module 110 may include a first heat exchange unit 112, which can perform heat exchange with contact air, a second heat exchange unit 114, which may be aligned in a line with the first heat exchange unit 112 and can perform heat exchange with contact air, a thermoelectric element 116, one surface of which comes into contact with the first heat exchange unit 112 and which can conduct heat to the first heat exchange unit 112, and a heat transfer member 118, which interconnects an opposite surface of the thermoelectric element 116 and the second heat exchange unit 114 and can conduct heat from the opposite surface of the thermoelectric element 116 to the second heat exchange unit 114.

The first heat exchange unit 112 and the second heat exchange unit 114 may be arranged in a single flow path. Both the first heat exchange unit 112 and the second heat exchange unit 114 may be arranged in the condenser duct 82.

The first heat exchange unit 112 and the second heat exchange unit 114 may be arranged on the same side of the heat transfer member 118. The first heat exchange unit 112 and the second heat exchange unit 114 may be arranged in a line. The first heat exchange unit 112 and the second heat exchange unit 114 may be arranged in the longitudinal direction of the heat transfer member 118.

The air inside the condenser duct 82 can undergo heat exchange with the first heat exchange unit 112 and the second heat exchange unit 114, which are arranged in the single flow path.

The first heat exchange unit 112 and the second heat exchange unit 114 may be placed at the same height. The first heat exchange unit 112 and the second heat exchange unit 114 may be placed in the same plane. The air moving in the condenser duct 82 can thus pass through the second heat exchange unit 114 and the first heat exchange unit 112 while experiencing minimal variation in vertical position. The moving air sequentially passes through the second heat exchange unit 114 and the first heat exchange unit 112, which are arranged in a line.

In order to minimize the movement distance of air, the second heat exchange unit 114 and the first heat exchange unit 112 may be arranged in a straight line.

The line along which the first and second heat exchange units 112 and 114 are arranged is not limited to a straight line. One example of a non-straight line arrangement may be one in which the first heat exchange unit 112 and the second heat exchange unit 114 are arranged in an arch form along the surface of the tub 20 or the drum 30.

The line arrangement may take a form in which the first heat exchange unit 112 and the second heat exchange unit 114 are arranged so as to cross each other with a prescribed angle therebetween.

The line arrangement refers to the first heat exchange unit 112 and the second heat exchange unit 114 being arranged along a single flow path.

In some cases, the first heat exchange unit 112 and the second heat exchange unit 114 may be arranged so as to form a straight line when viewed from the lateral side. Additionally, or alternatively, the first heat exchange unit 112 and the second heat exchange unit 114 may be arranged so as to form a straight line when viewed from the top side.

In other implementations, the first heat exchange unit 112 and the second heat exchange unit 114 may have different heights. Because air moves through the condenser duct 82, even if the heights of the first heat exchange unit 112 and the second heat exchange unit 114 differ slightly from each other, variation in the height of air may be minimized.

In some cases, the first heat exchange unit 112 and the second heat exchange unit 114 may define an angle therebetween. However, because the air moves along the condenser duct 82, most of the air may move along a straight path.

As illustrated in FIG. 3, the first heat exchange unit 112 and the second heat exchange unit 114 may be arranged in the longitudinal direction of the condenser duct 82. Alternatively, the first heat exchange unit 112 or the second heat exchange unit 114 may be arranged along a direction that is perpendicular to the longitudinal direction of the condenser duct 82.

The first heat exchange unit 112 may be located at the front side toward the door 15, and the second heat exchange unit 114 may be located at the rear side toward the drive unit 40. In some cases, the first heat exchange unit 112 and the second heat exchange unit 114 may be arranged at positions opposite to the above description.

The first heat exchange unit 112 and the second heat exchange unit 114 may be located below the heat transfer member 118. As such, the air can move below the heat transfer member 118.

In some cases, the first heat exchange unit 112 and the second heat exchange unit 114 may be located above the heat transfer member 118. In this case, the air may move above the heat transfer member 118.

The first heat exchange unit 112 and the second heat exchange unit 114 may both be arranged on the same side of the heat transfer member 118.

The heat transfer member 118 may be formed of a metal material having high heat transfer efficiency, for example copper, aluminum, or the like. The heat transfer member 118 may be a heat pipe.

When current is applied to the thermoelectric element 116, the thermoelectric element 116 may emit heat from a surface that is in contact with the first heat exchange unit 112, and may absorb heat through the surface is in contact with the second heat exchange unit 114.

The first heat exchange unit 112 may be installed so as to come into close contact with one surface 115 of the thermoelectric element 116, and the second heat exchange unit 114 may be installed so as to come into close contact with an opposite surface 117 of the thermoelectric element 116. Thus, the second heat exchange unit 114 can undergo heat exchange with the air passing therethrough to thereby cool the air. The first heat exchange unit 112 can undergo heat exchange with the air passing therethrough to thereby heat the air.

In other implementations, the first heat exchange unit 112 may take part in heat absorption, and the second heat exchange unit 114 may take part in heat emission.

As illustrated in FIG. 2, the air, which is directed to pass through the condenser duct 82, can sequentially pass through the second heat exchange unit 114, the first heat exchange unit 112, and then the heater 86.

The air passing through the condenser duct 82 may be cooled in the second heat exchange unit 114, be heated in the first heat exchange unit 112, and be reheated in the heater 86. The temperature of the heater 86 may be far higher than the temperature of the first heat exchange unit 112 when it is emitting heat.

The second heat exchange unit 114 may condense moisture contained in air by cooling the air. The second heat exchange unit 114 may dehumidify the air suctioned from the tub 20.

Condensed water from the second heat exchange unit 114 may move along the inner surface of the tub 20, and thereafter may be discharged outward via the pump 60.

A space 113 may be defined between the first heat exchange unit 112 and the second heat exchange unit 114. The space 113 can function to prevent or mitigate the movement of condensed water. For example, the space 113 may prevent the condensed water from moving from the second heat exchange unit 114 to the first heat exchange unit 112.

The space 113 may be set to a distance at which no capillary phenomenon can occur. Further, the space 113 may be set to a distance at which condensed water cannot be moved by the wind pressure of the condenser fan 84.

The space 113 may be set to a distance at which condensed water cannot be moved from the second heat exchange unit 114 to the first heat exchange unit 112 by the capillary phenomenon, that is, the surface tension of condensed water when the condenser fan 84 is operating at the maximum wind speed.

When condensed water is moved from the second heat exchange unit 114 to the first heat exchange unit 112, the condensed water may reduce the temperature of the first heat exchange unit 112, thus causing a deterioration in performance.

When the temperature of the first heat exchange unit 112 is reduced, the drying performance for drying fabric may be deteriorated, and the heater module 70 or the heater 86 may need to increase heat emission accordingly.

Dehumidification can be performed on the air that has passed through the second heat exchange unit 114, and the dehumidified air may then be heated while passing through the first heat exchange unit 112.

Then, the air may be heated to a temperature suitable for the drying of fabric while passing through the heater 86.

The thermoelectric module 110 may be located in a single flow path and perform not only the dehumidification of air moving in the single flow path, but also the heating of air by waste heat generated therefrom, thereby contributing to the improvement of power efficiency. In particular, because the dehumidification and heating of air are performed in a single flow path, the length of the flow path may be minimized.

In addition, because the air cooled during dehumidification can undergo heat exchange with the first heat exchange unit 112, this has the effect of maintaining the consistent performance of the thermoelectric element 116.

In addition, because the air may be heated using waste heat that is thrown out from the thermoelectric element 116, the load on the heater module 70 or the heater 86, which is used in the drying mode, may be reduced.

In addition, because the flow path of air, which passes through the second heat exchange unit 114, the first heat exchange unit 112, and the heater 86, may be installed in a line, rather than being branched or merged, resistance of air passing through may be minimized.

When the flow path of air is branched into two or more flow paths, or two or more flow paths are merged into one flow path, for example, an eddy or turbulence may be generated, and a dead space, in which the flow of air does not occur, may be created, which can increase the resistance of air and decreases flow.

However, as illustrated, because air is subjected to dehumidification, heating, and reheating while moving along a single flow path, the flow resistance of air may be minimized, and consequently, the load on the condenser fan 84 may be minimized.

While the condenser unit 80 is shown located on the top of the tub 20, the condenser unit 80 may alternatively be located at any of various positions on, for example, the side surface, the lower surface, or the rear surface of the tub 20.

In some cases, the second heat exchange unit 114 may be provided with a condensed water drop structure, which can enable more effective dropping of the produced condensed water.

In some cases, a slope 132 may be formed on the outer edge of the second heat exchange unit 114, such that condensed water can more effectively drop via the slope 132. The slope 132 is inclined relative to a vertical line.

The second heat exchange unit 114 may include a plurality of radiation fins 131, and therefore the slope 132 may be formed on each radiation fin 131.

The radiation fins 131 may be formed of a metal material having high thermal conductivity and may be arranged parallel to one another. The slope 132 may be formed on the edge of each radiation fin 131.

In particular, when the second heat exchange unit 114 is located below the heat transfer member 118, the slope 132 may help the condensed water to drop more effectively.

The thermoelectric module 110 may be horizontally oriented. But in some cases, the thermoelectric module may be oriented in the direction of gravity. When the thermoelectric module 110 is vertically oriented, the heat exchange unit, in which the condensed water is produced, may be located at the lower side.

The heat transfer member 118 may also be provided with a condensed water drop structure.

The heat transfer member 118 is provided with a jagged structure 133 at one end thereof, and the jagged structure 133 may be located on the side on which the second heat exchange unit 114 is disposed.

The jagged structure 133 may be connected to the slope 132.

Figure 5:
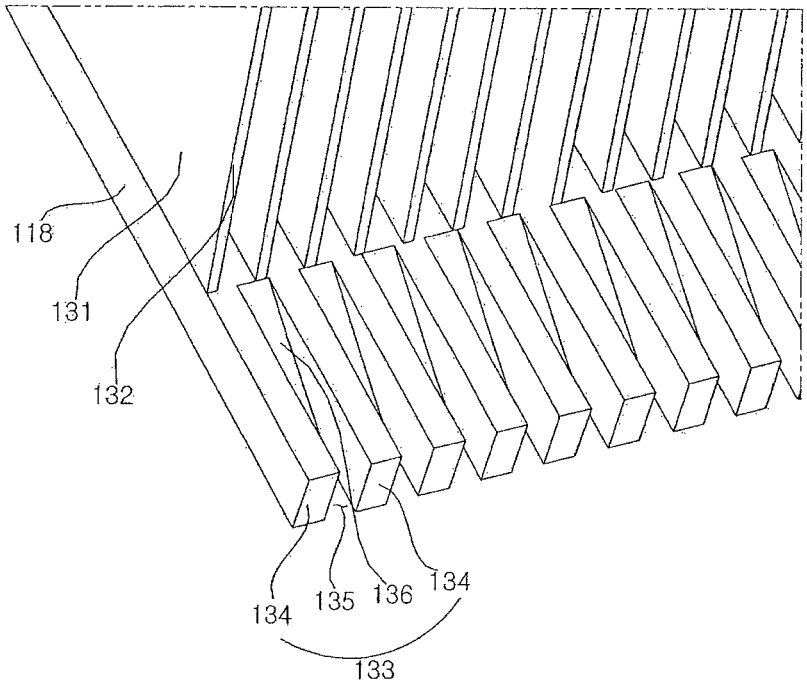
FIG. 5 is an enlarged perspective view of example drop portions illustrated in FIG. 4.

As illustrated in FIG. 5, the jagged structure 133 includes protruding drop portions 134, which extend in the longitudinal direction of the heat transfer member 118, and grooves 135 formed between the protruding drop portions 134.

Each of the grooves 135 may be provided with an inclined protruding portion 136.

One radiation fin 131 may be located on one protruding drop portion 134. In this case, the grooves 135 may be located between the radiation fins 131.

The protruding drop portion 134 may have the same thickness as the heat transfer member 118. In some cases, the protruding drop portion 134 may have a gradually reduced thickness.

The inclined protruding portion 136 may gradually reduced in thickness with decreasing distance to the end of the heat transfer member 118.

Through the provision of the grooves 135, the surface area of the heat transfer member 118 may be considerably increased.

The condensed water, produced in the second heat exchange unit 114, may move to the jagged structure 133 along the slope 132, and thereafter may agglomerate into large water droplets. The agglomerated water droplets easily drop due to the increased weight thereof.

Although the jagged structure 133 is shown formed at the heat transfer member 118, the radiation fins 131 may be provided with a jagged structure as well.

In addition, although the heat transfer member 118 and the radiation fins 131 may be separately manufactured, the heat transfer member 118 and the radiation fins 131 may also be integrally manufactured.

Figure 6:
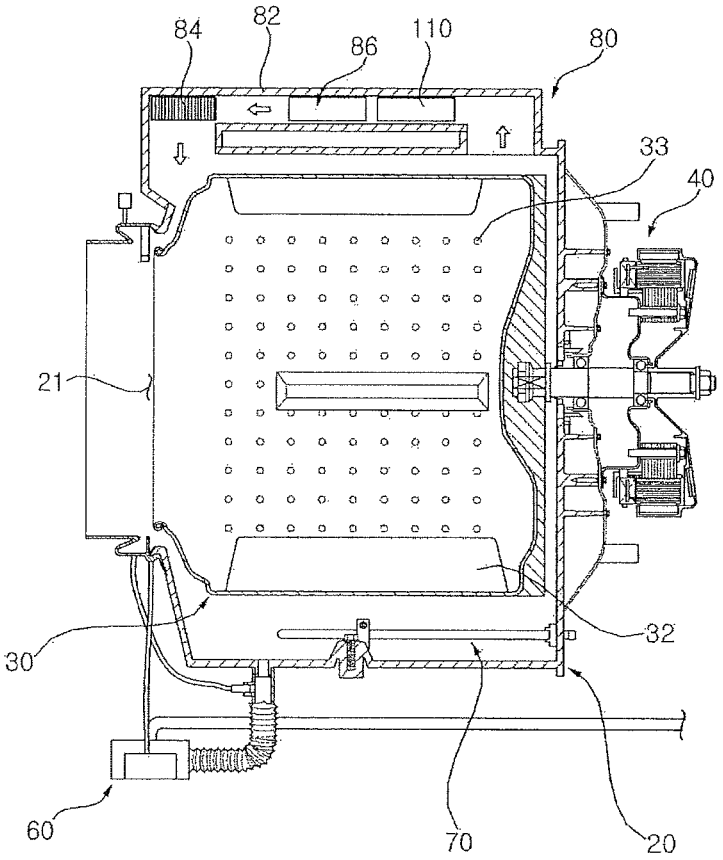
FIG. 6 is a sectional view illustrating an example condenser unit included in a washing machine according to another implementation.
Figure 7:
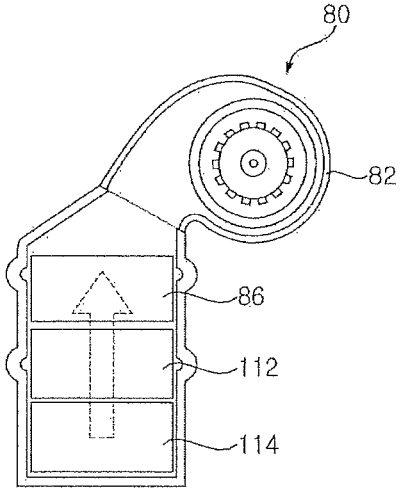
FIG. 7 is a plan view illustrating the interior of the condenser unit illustrated in FIG. 6.

Referring to FIGS. 6 and 7, in the condenser unit 80 of the washing machine in accordance with one implementation, the condenser fan 84 is located at the outlet side of the condenser duct 82. The condenser fan 84 blows the air inside the condenser duct 82 into the drum 30.

The air, suctioned from the inlet side of the condenser duct 82, can pass through the thermoelectric module 110 and the heater 86, and then move into the tub 20.

The inlet of the condenser duct 82 may be located at the rear side, and the outlet of the condenser duct 82 may be located at the front side.

Because the condenser fan 84 may be installed at the outlet side of the condenser duct 82, there may be an advantage in that heated air may be more forcibly discharged into the tub 20.

Because the heated air may be discharged into the drum 30 through the condenser fan 84, the time it takes for the fabric inside the drum 30 to become dried may be reduced.

The air, discharged through the condenser fan 84, may be directed to the fabric. Specifically, the air discharged from the condenser fan 84 may be directed to the rear lower side of the drum 30. As such, the heated air may be discharged from the front upper side of the tub 20 to the rear lower side of the tub 20.

The direction in which the air is discharged from the condenser fan 84 may be guided so as to allow the heated air to be directly supplied to the fabric. By minimizing the distance required for the heated air to reach the fabric, it can be possible to minimize the reduction in temperature while the air moves, and consequently, to minimize power consumption.

In addition, when the direction in which the air is discharged from the condenser fan 84 is guided, the air inside the tub 20 may be more effectively circulated.

An improvement in the drying speed of fabric may cause a reduction in the power consumption of the heater 86 and the heater module 70, which are used for drying.

In this case, the air suctioned into the condenser duct 82 is also subjected to dehumidification, heating, and reheating.

As such, as described above, the second heat exchange unit 114, the first heat exchange unit 112, and the heater 86 may be arranged in a line within the condenser duct 82.

The other components can be the same as described above with respect to FIGS. 1-5, and thus a detailed description thereof will be omitted below.

Figure 8:
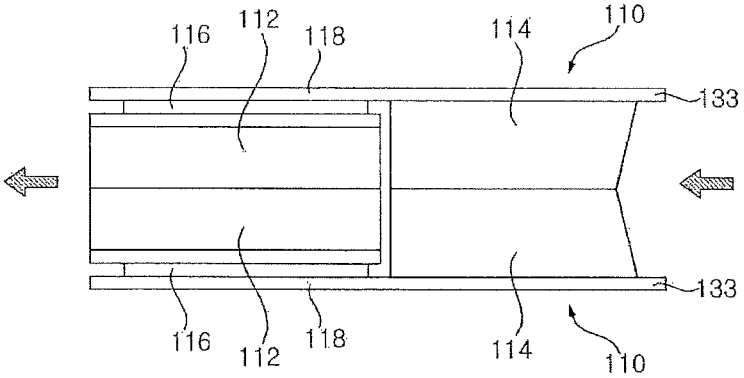
FIG. 8 is a sectional view illustrating an example condenser unit according to another implementation.

Referring to FIG. 8, a plurality of thermoelectric modules may be installed to face each other. In particular, the heat transfer members 118 may be located at opposite edges, and the heat exchange units 112 and 114 may be arranged between the heat transfer members 118. Air may be directed to move between the heat transfer members 118.

Provided between the heat transfer members 118 are two first heat exchange units 112, which form a pair so as to face each other, and two second heat exchange units 114, which form a pair so as to face each other.

As illustrated, air can move between the two heat transfer members 118, and this can be advantageous for heat exchange between the air and the first heat exchange units 112 and the second heat exchange units 114.

Because the air moves between the two heat transfer members 118, it can be possible to minimize the amount of air that moves without heat exchange, compared to the case where one thermoelectric module 110 is installed.

The two thermoelectric modules 110, which are arranged to face each other, may be vertically upright. Alternatively, the two thermoelectric modules 110, which are arranged to face each other, may be horizontally upright. In yet another alternative, the two thermoelectric modules 110, which are arranged to face each other, may be obliquely oriented.

The other components can be the same as those described above with reference to FIGS. 1 to 5, and thus a detailed description thereof will be omitted below.

Figure 9:
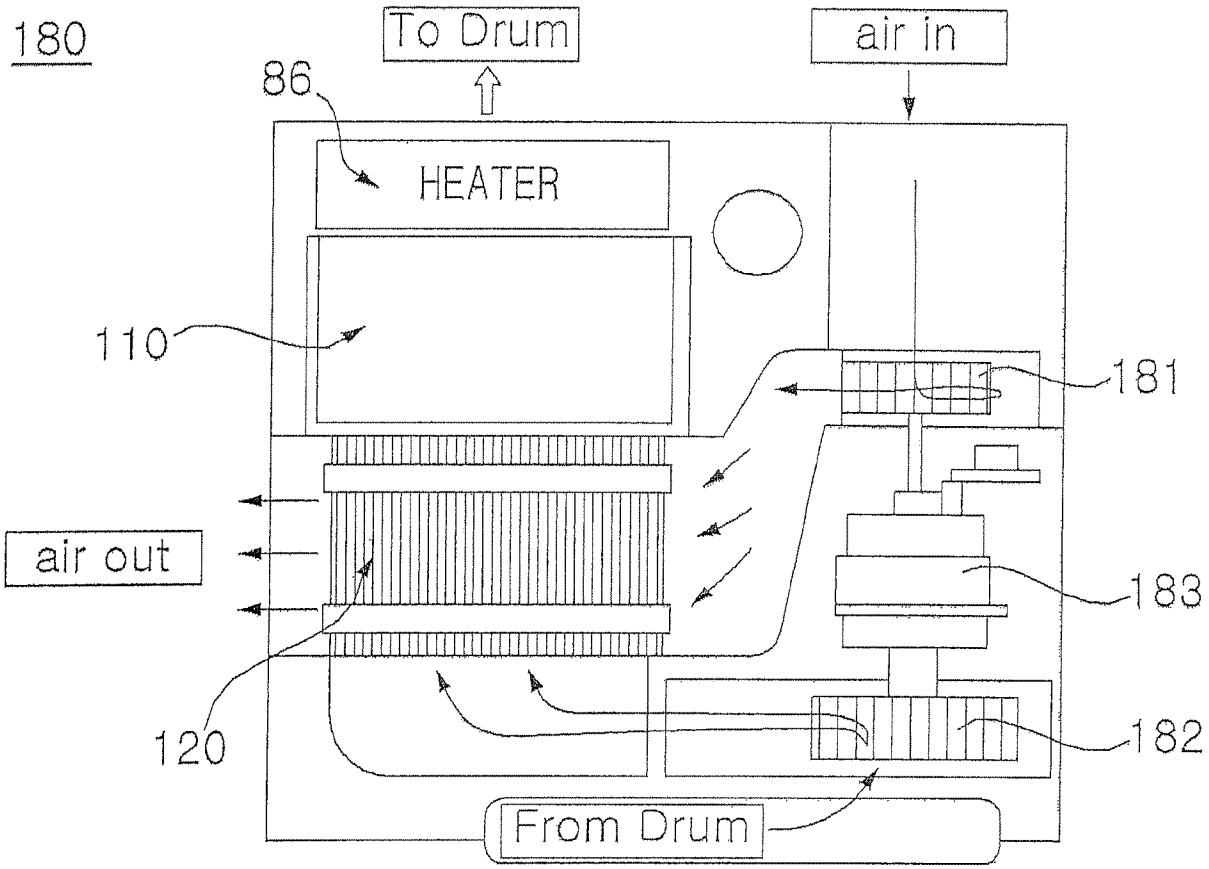
FIG. 9 is a plan view illustrating an example condenser unit of a condensation type drying machine according to another implementation.
Figure 10:
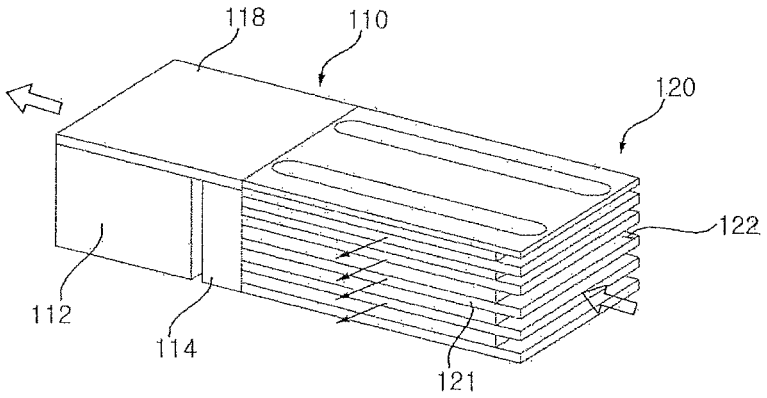
FIG. 10 is a perspective view of an example thermoelectric module and an example condensation heat exchanger illustrated in FIG. 9.

Referring now to FIGS. 9 and 10, a condensation type drying machine is illustrated. The thermoelectric module 110, which was described above, may be installed in the condensation type drying machine. The condensation type drying machine is configured to remove moisture from circulating air and to dry fabric.

The drying machine can be provided only with a drum, without a tub, unlike the washing machine.

The drum, installed in the drying machine, does not need to pass wash water, and therefore does not require the drum through-holes 33 formed therein.

In the illustrated drying machine, the circulating air first undergoes heat exchange with a condensation heat exchanger 120, and thereafter undergoes heat exchange with the thermoelectric module 110.

A condenser unit 180 may be located below the drum. The condenser unit 180 may be located in the lower region of the cabinet 10.

The condenser unit 180 may include the condensation heat exchanger 120, which includes a first heat exchange flow path 121, through which outside air moves, and a second heat exchange flow path 122, through which the air inside the drum moves, the condensation heat exchanger 120 undergoing heat exchange between the outside air and the air inside the drum, a first fan 181, which is configured to move the outside air to the first heat exchange flow path 121, a second fan 182, which is configured to move the air inside the drum to the second heat exchange flow path 122, a condensation motor 183, which is configured to drive the first fan 181 and the second fan 182, the thermoelectric module 110, which is configured to undergo heat exchange with the air having passed through the second heat exchange flow path 122, and the heater 86, which is configured to heat the air having passed through the thermoelectric module 110.

The condensation heat exchanger 120 serves to enable heat exchange between the air circulating inside the drum and the outside air. The condenser unit 180 uses the outside air in order to cool the air circulating inside the drum. When the air circulating inside the drum is cooled using the outside air, power consumption may be reduced.

In the condensation heat exchanger 120, the first heat exchange flow path 121, through which the outside air moves, is configured as a single layer, and the second heat exchange flow path 122 may be configured as an upper or lower layer relative to the first heat exchange flow path 121.

The first heat exchange flow path 121 and the second heat exchange flow path 122 may be stacked one above another. Specifically, a plurality of first heat exchange flow paths 121 and a plurality of second heat exchange flow paths 122 may be alternately stacked one above another.

The first heat exchange flow path 121 and the second heat exchange flow path 122 may be oriented so that the directions in which the air moves cross each other. As illustrated, the first heat exchange flow path 121 and the second heat exchange flow path 122 cross each other with an angle of 90 degrees therebetween.

When the air inside the drum moves through the second heat exchange flow path 122, the air can lose heat to the outside air, thus producing condensed water. The condensation heat exchanger 120 cools the air inside the drum using the outside air, which has a low temperature, and removes moisture from the air inside the drum.

The thermoelectric module 110 may be located between the condensation heat exchanger 120 and the heater 86.

The second heat exchange flow path 122 and the second heat exchange unit 114 may be arranged in a line. The air that has passed through the second heat exchange flow path 122 can thus move to the second heat exchange unit 114 in a straight path.

As described above, the thermoelectric module 110 may be arranged in the order of the second heat exchange unit 114 (for heat absorption) and the first heat exchange unit 112 (for heat emission).

The second heat exchange unit 114 can repeatedly perform dehumidification on the air having passed through the condensation heat exchanger 120. The second heat exchange unit 114 can have a lower temperature than that of the outside air.

The air inside the drum may be primarily dehumidified while passing through the condensation heat exchanger 120, and may be secondarily dehumidified while passing through the second heat exchange unit 114 (for heat absorption).

The second heat exchange unit 114 may cool the air to a lower temperature than that in the condensation heat exchanger 120.

Here, because the air inside the drum passes through the second heat exchange flow path 122 and the second heat exchange unit 114 in a straight line, the resistance attributable to air may be minimized.

The air, which has been secondarily dehumidified in the second heat exchange unit 114, is primarily heated while passing through the first heat exchange unit 112. Then, the air having passed through the first heat exchange unit 112, is secondarily heated while passing through the heater 86.

The heater 86 may be set at a higher temperature than that of the first heat exchange unit 112.

The air having passed through the heater 86 is supplied into the drum, thus serving to dry the fabric inside the drum.

The condensation motor 183 may drive the first fan 181 and the second fan 182 at the same time. In some cases, respective motors may be provided to drive the first fan 181 and the second fan 182 separately.

When the condensation motor 183 is driven, the first fan 181 and the second fan 182 are driven at the same time, thus causing the simultaneous movement of outside air and inside air.

In some cases, components such as, for example, a duct may be installed in order to move the outside air from the first fan 181 to the condensation heat exchanger 120.

In addition, a duct for the movement of air may also be installed between the second fan 182 and the condensation heat exchanger 120.

Figure 11:
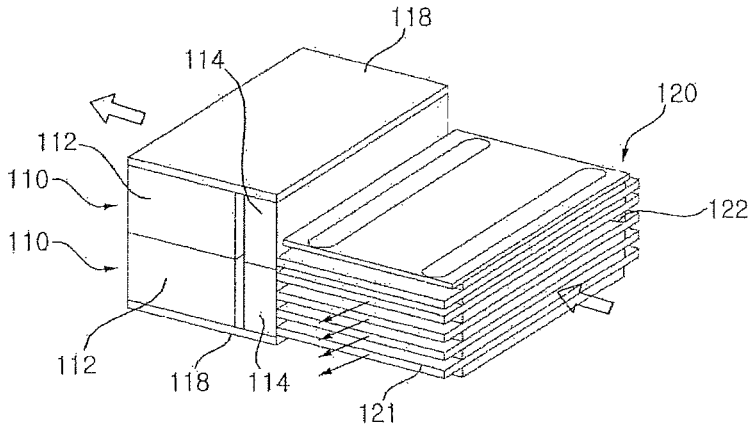
FIG. 11 is a perspective view of the thermoelectric module and the condensation heat exchanger according to another implementation.

Referring now to FIG. 11, two thermoelectric modules 110 are arranged so as to face each other. Here, the second heat exchange unit 114 may be located toward the condensation heat exchanger 120.

Because the second heat exchange unit 114 is provided in a plural number, an increased amount of air may be secondarily dehumidified.

In addition, because two thermoelectric elements 116 are provided to cool the respective second heat exchange units 114, the amount of air to be dehumidified may be more actively controlled.

For example, when it is necessary to vaporize a large amount of moisture from fabric, both of the thermoelectric modules 110 may be operated. When it is necessary to vaporize a small amount of moisture, only one thermoelectric module 110 may be operated.

The two first heat exchange units 112 may be arranged so as to be in contact with each other, and the two second heat exchange units 114 may be arranged so as to be in contact with each other. In this case, even when only one then thermoelectric module 110 is operated, heat may be conducted to the opposite thermoelectric module.

Because heat may be transferred via conduction even though only one thermoelectric module 110 is operated, the efficiency of dehumidification or heating by the thermoelectric module 110 may be improved.

In addition, even when only one thermoelectric module 110 is operated, the resulting air contact area is doubled.

Figure 12:
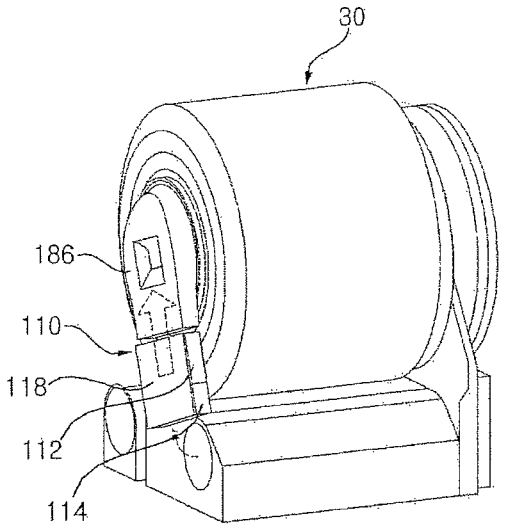
FIG. 12 is a perspective view illustrating the interior of an example exhaust type drying machine.
Figure 13:
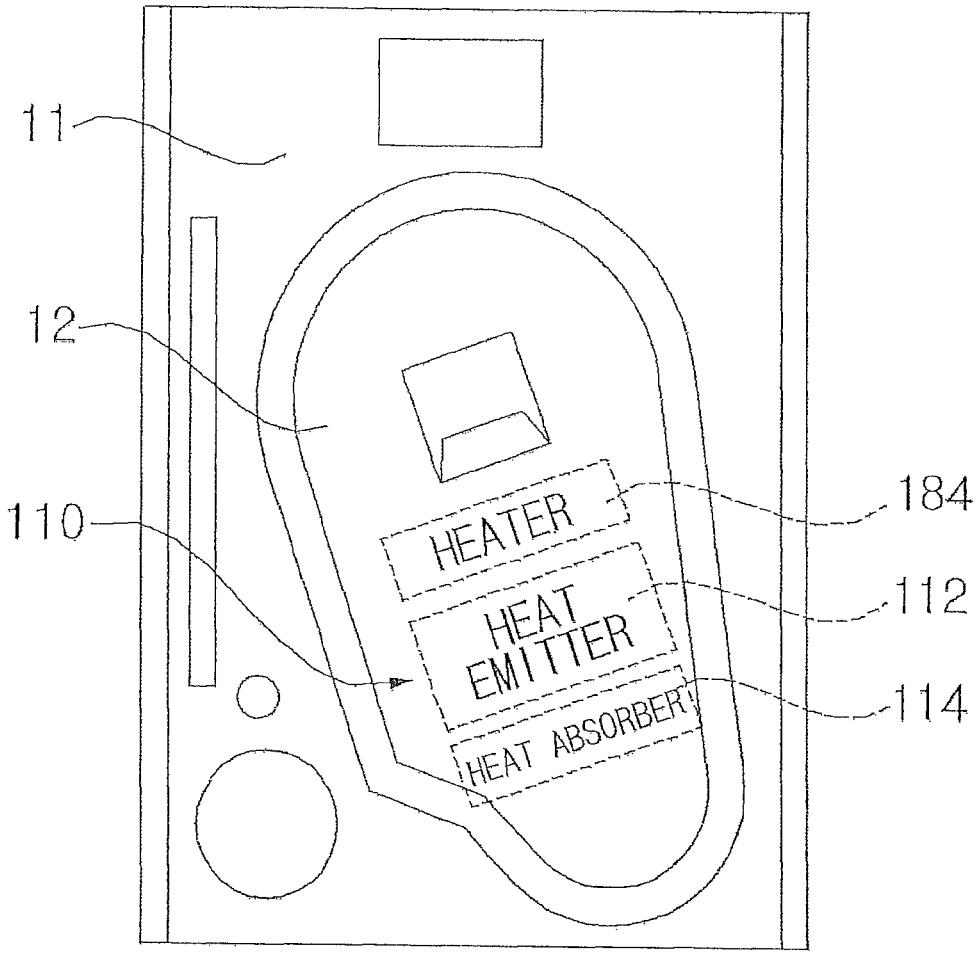
FIG. 13 is a front view of a condenser unit illustrated in FIG. 12.

Referring now to FIGS. 12 and 13, an exhaust type drying machine is shown. As illustrated, the exhaust type drying machine is configured to heat air suctioned from outside to a prescribed temperature and to supply the heated air into the drum 30 so as to dry fabric, and to discharge the air from the drum 30 to the outside.

Here, the air, discharged from the drum 30, can be dehumidified, and thereafter can be discharged outward from a cabinet.

The thermoelectric module 110 may be located on the rear surface of the drum 30.

Air may be dehumidified while passing through the second heat exchange unit 114 and heated while passing through the first heat exchange unit 112.

The air having passed through the thermoelectric module 110 may be supplied into the drum 30 after being heated by the heater 186.

The air heated by the heater 186 may be supplied into the drum 30 through the shaft center of the drum 30.

Reference numeral 11 designates a rear panel 11, which constitutes the cabinet 10. The rear panel 111 may be provided with a guide 12, which guides the air to the thermoelectric module 110 and the heater 86.

Here, the thermoelectric module 110 may be oriented in the direction of gravity.

The second heat exchange unit 114 of the thermoelectric module 110 may be located lower than the first heat exchange unit 112. As such, the jagged structure may be located at the lowermost end of the thermoelectric module 110.

Figure 14:
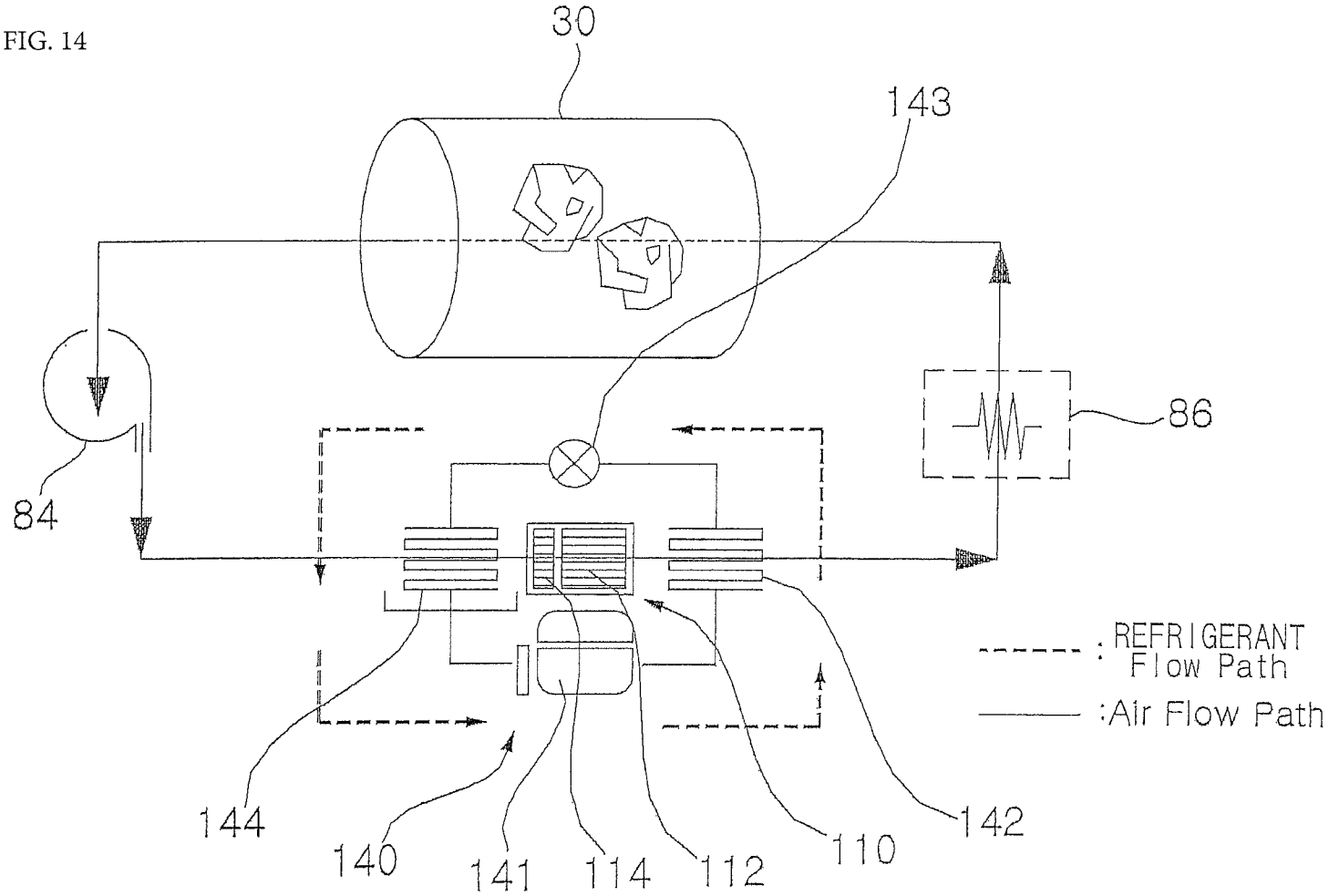
FIG. 14 is a schematic view illustrating an example configuration of a condensation type drying machine equipped with a heat pump module.

Referring to FIG. 14, illustrated is a condensation type drying machine, which is equipped with a heat pump module 140 and the thermoelectric module 110.

The air inside the drum 30 is subjected to dehumidification and heating by the thermoelectric module 110 and the heat pump module 140.

The heat pump module 140 includes a first heat exchanger 142, a second heat exchanger 144, an expansion valve 143, and a compressor 141, and may have a heat pump operating cycle.

When operating in a cooling cycle, the first heat exchanger 142 serves as a condenser and the second heat exchanger 144 serves as an evaporator.

That is, refrigerant discharged from the compressor 141 is condensed into liquid-phase refrigerant in the first heat exchanger 142, and emits heat to the surroundings.

The liquid-phase refrigerant condensed in the first heat exchanger 142 can expand in the expansion valve 143 to thereby be atomized.

The refrigerant expanded in the expansion valve 143 can be vaporized into gas-phase refrigerant in the second heat exchanger 144 and absorbs heat from the surroundings.

The gas-phase refrigerant vaporized in the second heat exchanger 144 moves to the compressor 141, and the process described above can be repeated.

Accordingly, the second heat exchanger 144 can cool the air discharged from the condenser fan 84 and dehumidify the air so as to remove moisture contained in the air.

Here, the first heat exchanger 142 heats the air having passed through the thermoelectric module 110 using condensation heat.

That is, the air discharged from the condenser fan 84 sequentially passes the second heat exchanger 144, the thermoelectric module 110, the first heat exchanger 142, and the heater 86.

The thermoelectric module 110 dehumidifies the air by cooling the air, and thereafter heats the air. In the thermoelectric module 110, the second heat exchange unit 114 is located toward the second heat exchanger 144 (i.e. the evaporator), and the first heat exchange unit 112 is located toward the first heat exchanger 142 (i.e. the condenser).

As such, the air discharged from the condenser fan 84 is primarily dehumidified in the second heat exchanger 144, and thereafter is secondarily dehumidified in the second heat exchange unit 114.

Then, the air is primarily heated in the first heat exchange unit 112, is secondarily heated in the first heat exchange unit 142, and is thirdly heated in the heater 86.

The air moves into the drum 30 after being thirdly heated to a prescribed temperature.

The drying machine in accordance with this implementation may take advantage of both heat absorption and heat emission occurring in the heat pump module 140 and the thermoelectric module 110, thereby reducing power consumption and also reducing the load on the heater 86.

Figure 15:
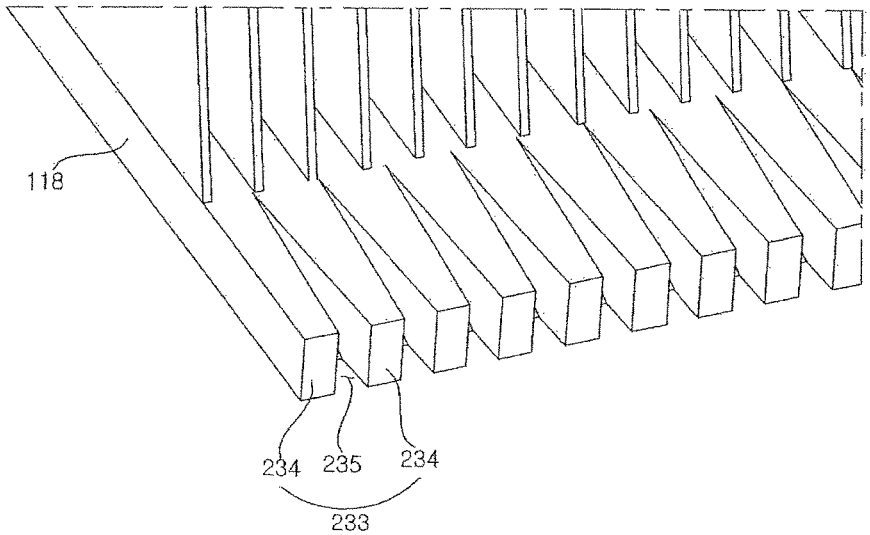
FIG. 15 is a partial perspective view illustrating an example jagged structure.

Referring now to FIG. 15, a jagged structure 233 includes protruding drop portions 234, at least one surface of which has a gradually reduced area.

As illustrated, the end of the protruding drop portion 234 may be shaped so that the width thereof is gradually reduced. The protruding drop portion 234 may have a trapezoidal shape when viewed from the top side.

A groove 235 between the protruding drop portions 234 may have a wedge shape. The groove 235 may be shaped so that the width of an end thereof is gradually increased.

The other components of the jagged structure 233 are the same as those of the jagged structure 133 described above, and thus a detailed description thereof will be omitted below.

Figure 16:
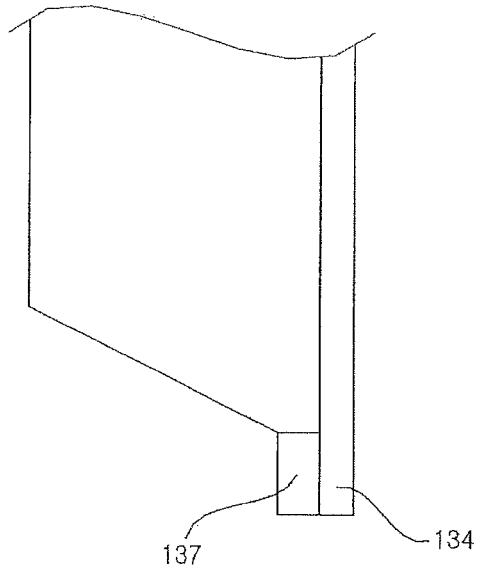
FIG. 16 is a side view illustrating an example second heat exchange unit.

Referring to FIG. 16, an absorption member 137 is installed to absorb condensed water. The absorption member 137 may more rapidly collect and agglomerate condensed water. The absorption member 137 may be located on the protruding drop portion 134.

The absorption member 137 may be formed of a porous material, such as sponge.

Instead of, or in addition to, the absorption member 137, a hydrophilic coating may be used.

Figure 17:
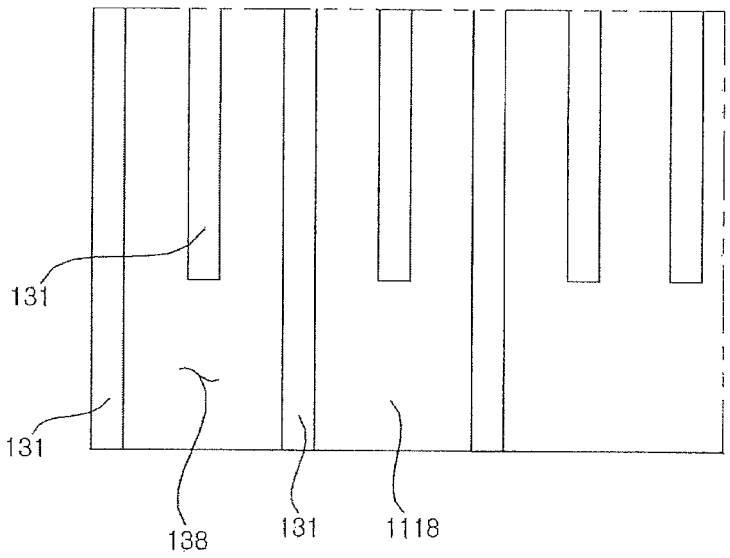
FIG. 17 is a plan view illustrating example radiation fins included in a second heat exchange unit.

Referring now to FIG. 17, instead of the jagged structure, the radiation fins 131 may have different lengths, so as to allow condensed water to be collected between the ends thereof. That is, the ends of the radiation fins 131 may be arranged in a zigzag manner.

With the zigzag arrangement of the ends, a condensed water collection space 138 can be defined between the ends of the radiation fins 131. The condensed water collected in the condensed water collection space 138 has high surface tension, thus causing water droplets to grow to a large size.

As is apparent from the above description, the present disclosure can have one or more effects as follows.

First, upon drying of fabric, the load on a heater may be reduced, owing to the use of a thermoelectric module.

Second, compared to a laundry treatment apparatus in which only a heater is installed, increased heat emission efficiency and reduced power consumption for drying may be accomplished.

Third, because air to be circulated or exhausted sequentially passes through the heat absorption side and the heat emission side of the thermoelectric module, which are arranged in a line, the resistance of air may be minimized.

Fourth, because all of the energy generated at the heat absorption side and the heat emission side of the thermoelectric module may be used, the thermoelectric module may achieve improved efficiency.

Fifth, the interaction between the thermoelectric module and a condensation heat exchanger, which performs dehumidification, may maximize the dehumidification efficiency.

Sixth, the thermoelectric module may achieve maximized efficiency when it is located between the condensation heat exchanger and the heater.

Seventh, the thermoelectric module may achieve maximized efficiency when it is located between an evaporator and a condenser, which constitute a heat pump module.

Eighth, it can be possible to prevent produced condensed water from moving to the heat emission side of the thermoelectric module.

Ninth, a jagged structure formed on a heat transfer member may facilitate a rapid growth of the produced condensed water into water droplets that can drop.

Tenth, through the provision of, for example, slopes on radiation fins, the jagged structure on the heat transfer member, and the zigzag arrangement of radiation fins, the produced condensed water may be rapidly grown into water droplets that can drop.

Objects of the present disclosure should not be limited to the aforementioned objects and other not-mentioned objects will be clearly understood by those skilled in the art from the following description.

Although example implementations have been illustrated and described, the present disclosure is not limited to the above described particular implementations, and various modifications, additions and substitutions are possible by those skilled in the art without departing from the scope and spirit of the disclosure as disclosed in the accompanying claims. All the modifications, additions and substitutions are not intended to be understood individually from the technical sprit or outlook of the present disclosure.

What is claimed is:

1. A laundry treatment apparatus equipped with a thermoelectric module, the apparatus comprising:

a thermoelectric element with a first surface and a second surface that is opposite the first surface, and that is configured to emit heat from the first surface and to absorb heat through the second surface;

a first heat exchange unit that is configured to contact the first surface of the thermoelectric element to undergo heat exchange with air when heat is received from the first surface;

a heat transfer member with an interconnecting surface that is configured to contact the second surface of the thermoelectric element;

a second heat exchange unit that is configured to contact the interconnecting surface of the heat transfer member, and that is configured to undergo heat exchange with air to enable heat to be absorbed by the second surface of the thermoelectric element through the heat transfer member;

a plurality of radiation fins disposed in the second heat exchange unit, and that are configured to extend along a longitudinal direction of the heat transfer member;

a plurality of protruding drop portions disposed in the heat transfer member, that are arranged in parallel with the plurality of radiation fins, and that are configured to extend in a longitudinal direction of the heat transfer member; and a sloped groove formed between each pair of adjacent protruding drop portions, that is configured to slope downward away from the plurality of radiation fins, wherein the plurality of protruding drop portions and the sloped grooves are located on an outer side of the plurality of radiation fins.

2. The laundry treatment apparatus according to claim 1, wherein a space is defined between the first heat exchange unit and the second heat exchange unit, the space is configured to prevent movement of condensed water from the second heat exchange unit to the first heat exchange unit.

3. The laundry treatment apparatus according to claim 1, wherein the first heat exchange unit and the second heat exchange unit are arranged in a line.

4. The laundry treatment apparatus according to claim 1, wherein the first heat exchange unit is configured to emit heat during heat exchange with air, and the second heat exchange unit is configured to absorb heat during heat exchange with air.

5. The laundry treatment apparatus according to claim 1, wherein at least one of the first heat exchange unit or the second heat exchange unit includes a sloped surface that is configured to guide condensed water.

6. The laundry treatment apparatus according to claim 1, wherein ends of the plurality of radiation fins are arranged in a zigzag form.

7. The laundry treatment apparatus according to claim 1, wherein the first heat exchange unit and the second heat exchange unit are vertically arranged.

8. The laundry treatment apparatus according to claim 1, wherein the first heat exchange unit and the second heat exchange unit are horizontally arranged.

9. The laundry treatment apparatus according to claim 1, further comprising:

a cabinet that defines an external appearance of the laundry treatment apparatus;

a tub that is configured to receive wash water;

a drum that is located inside the tub, and that is configured to receive fabric and to rotate; and a condenser unit that is connected to the tub, and that is configured to remove moisture by circulating air inside the tub, wherein the condenser unit includes:

a condenser duct that is connected to the tub, and that is configured to enable circulation of the air inside the tub, and a condenser fan that is installed in the condenser duct, and that is configured to circulate the air inside the tub, and wherein the thermoelectric module is installed in the condenser duct and is configured to cool and heat the air moving along the condenser duct.

10. The laundry treatment apparatus according to claim 9, further comprising:

a heater that is installed in the condenser duct and that is configured to heat the air that passed through the thermoelectric module, wherein the second heat exchange unit is configured to condense moisture in the air by cooling the air, and the first heat exchange unit is configured to heat the air from which the moisture has been condensed, and wherein the heater is configured to heat the air that passed through the first heat exchange unit.

11. The laundry treatment apparatus according to claim 10, wherein the thermoelectric module is located between the condenser fan and the heater.

12. The laundry treatment apparatus according to claim 10, wherein the second heat exchange unit, the first heat exchange unit, and the heater are sequentially arranged in a line.

13. The laundry treatment apparatus according to claim 9, wherein the thermoelectric module includes two thermoelectric modules arranged to face each other, and wherein the two first heat exchange units and the two second heat exchange units are arranged between the two heat transfer members.

14. The laundry treatment apparatus according to claim 1, further comprising:

a cabinet that defines an external appearance of the laundry treatment apparatus;

a drum that is located inside the cabinet, and that is configured to receive fabric and to rotate; and a condenser unit that is installed in the cabinet, and that is configured to remove moisture by circulating air inside the drum, wherein the condenser unit includes:

a condensation heat exchanger that defines a first heat exchange flow path for movement of outside air and a second heat exchange flow path for movement of the air inside the drum, and that is configured to perform heat exchange between the outside air and the air inside the drum to dehumidify the air inside the drum, and wherein the thermoelectric module is configured to dehumidify and heat the air that passes through the second heat exchange flow path.

15. The laundry treatment apparatus according to claim 14, further comprising a heater that is configured to heat the air that passed through the thermoelectric module before the air moves to the drum, wherein the second heat exchange unit is configured to condense moisture in the air by cooling the air, and the first heat exchange unit is configured to heat the air from which the moisture has been condensed, and wherein the heater is configured to heat the air that passed through the first heat exchange unit.

16. The laundry treatment apparatus according to claim 14, wherein the thermoelectric module is located between the condensation heat exchanger and the heater.

17. The laundry treatment apparatus according to claim 1, wherein the thermoelectric element is configured to emit heat based on the Peltier effect.

* * * * *